US005214933A

United States Patent [19]

Aitchison et al.

[11] Patent Number: 5,214,933

[45] Date of Patent: Jun. 1, 1993

[54] SELF-COOLING FLUID CONTAINER

[75] Inventors: Gary R. Aitchison, Mississauga; Michael W. Hetherington, Mount Albert, both of Canada

[73] Assignee: Envirochill International Ltd., Bridgetown, Barbados

[21] Appl. No.: 827,464

[22] Filed: Jan. 29, 1992

[51] Int. Cl.[5] ..... F25D 3/10; F17C 13/00; F25B 21/00

[52] U.S. Cl. ..... 62/294; 62/457.2; 62/457.9

[58] Field of Search ..... 62/294, 457.9, 457.2

[56] References Cited

U.S. PATENT DOCUMENTS

| | | | |
|---|---|---|---|
| 2,898,747 | 8/1959 | Wales | 62/294 |
| 3,257,821 | 6/1966 | Warner | 62/530 |
| 3,309,890 | 3/1967 | Barnett et al. | 62/294 |
| 3,320,767 | 5/1967 | Whalen | 62/294 |
| 3,338,067 | 8/1967 | Warner | 62/294 |
| 3,369,369 | 2/1968 | Weiss | 62/4 |
| 3,373,581 | 3/1968 | Strader | 62/294 |
| 3,417,573 | 12/1968 | Warner | 62/60 |
| 3,494,142 | 2/1970 | Beck | 62/294 |
| 3,494,143 | 2/1970 | Barnett et al. | 62/294 |
| 3,636,726 | 1/1972 | Rosenfeld et al. | 62/294 |
| 3,696,633 | 10/1972 | Mills | 62/294 |
| 3,759,060 | 9/1973 | Chase | 62/60 X |
| 3,852,975 | 12/1974 | Beck | 62/294 |
| 3,881,321 | 5/1975 | Riley | 62/294 |
| 3,990,613 | 11/1976 | Wray | 222/402 |
| 4,584,848 | 4/1986 | Barnett | 62/294 |
| 4,656,838 | 4/1987 | Shen | 62/294 |
| 4,669,273 | 6/1987 | Fischer et al. | 62/294 |
| 4,688,395 | 8/1987 | Holcomb | 62/457.2 X |
| 4,791,789 | 12/1988 | Wilson | 62/293 |
| 4,802,343 | 2/1989 | Rudick et al. | 62/294 |
| 4,838,242 | 6/1989 | Oblon | 126/263 |
| 4,925,470 | 5/1990 | Chou | 62/294 X |
| 4,928,495 | 5/1990 | Siegel | 62/4 |
| 4,941,328 | 7/1990 | Sheu | 62/457.9 X |
| 4,993,236 | 2/1991 | Wilson | 62/293 |
| 4,993,237 | 2/1991 | Bond et al. | 62/294 |
| 5,042,258 | 8/1991 | Sundhar | 62/3.62 |
| 5,079,932 | 1/1992 | Siegel | 62/293 |

FOREIGN PATENT DOCUMENTS

| | | | |
|---|---|---|---|
| 513015 | 2/1921 | France | 62/294 |
| 0003758 | 1/1977 | Japan | 62/294 |

*Primary Examiner*—Henry A. Bennet
*Assistant Examiner*—Christopher Kilner
*Attorney, Agent, or Firm*—Lahive & Cockfield

[57] ABSTRACT

A self-cooling fluid container includes a fluid chamber for containing the fluid-to-be-cooled. A refrigerant chamber, containing a pressurized refrigerant, is affixed to the base of the fluid chamber and extends at least partially into the fluid chamber. The interior region of the refrigerant chamber is fluidicly isolated from and thermally coupled to the interior region of the fluid chamber. A refrigerant dispersal assembly defines a vented dispersal region including a portion adjacent to the refrigerant chamber and separated from the interior of that chamber by a perforatable wall. A cooling activator is adapted to selectively form a fluidic path from the interior of the refrigerant chamber to the dispersal region through the perforatable wall, permitting release and expansion of the pressurized refrigerant.

30 Claims, 4 Drawing Sheets

SELF-COOLING FLUID CONTAINER

FIELD OF THE INVENTION

This invention relates generally to self-cooling fluid containers and specifically to an internal self-cooling beverage container.

BACKGROUND OF THE INVENTION

Heretofore, self-cooling beverage containers have not met with widespread commercial success owing to a variety of design deficiencies. Complexity of design structure has rendered many known devices as impractical. Safety, in some cases, has presented a concern. The opportunity for contact between the refrigerant and beverage creates a risk of altering beverage quality at best and toxicity to the consumer at worst. Further, other known devices wherein the refrigerant is vented in association with the tab opening of the container presented a serious safety hazard. When vented, the evaporating refrigerant was expelled upwards towards the face of the consumer with liquid particles of refrigerant being borne within the refrigerant vapor. This problem was addressed in U.S. Pat. No. 3,852,975 to Beck which teaches a container provided with a safety shield to protect the consumer from the upwardly expelled spray. Inefficiency of refrigeration and/or environmental concerns have been other deficiencies of known devices.

SUMMARY OF THE INVENTION

Accordingly, it is an object of the present invention to provide an efficient, simple, consumer-convenient and economical self-cooling fluid container which will overcome the aforesaid problems of the prior art.

It is a further object of the present invention to provide a self-cooling beverage container, not only well-adapted for the "outdoorsmen", but as an economical alternative to the use of auxiliary refrigeration.

It is a further object of the present invention to provide an "ecology-friendly", self-cooling beverage container which is adapted for the use of new, non-toxic and ozone-neutral hydrofluorocarbons (HFCs) and which is readily recyclable after use.

These and other objects are realized in one embodiment of the present invention comprising a beverage container of conventional exterior dimensions, readily adaptable to existing packaging, stacking, transporting and handling needs. An upper chamber containing the beverage to be cooled is axially provided with a refrigerant chamber affixed to the base of the upper chamber and extending at least partially into the upper chamber. The interior region of the refrigerant chamber is fluidicly isolated from the interior region of the upper chamber.

The pressurized refrigerant chamber contains an environmentally friendly refrigerant of a determined quantity in liquid form and is provided at its lower end by a sealed aperture integral with the base of the upper chamber.

A third chamber serves several functions. Firstly, it provides a means for conveniently venting the refrigerant chamber by delivering a seal opening member to the sealed aperture. Secondly, it provides a venting chamber, or refrigerant dispersal assembly, wherein the volatile evaporating refrigerant is vented and decelerated, thus eliminating the risk of a blast of spray being directed at the consumer. Further, the third chamber increases refrigeration efficiency by maximizing the surface area of cooling to include not only the refrigerant chamber, but also the lower portion of the surface of the upper beverage container. This third unpressurized chamber may be formed as a separate generally cup-shaped cap in preferably threaded engagement to the base of the upper chamber. The inner surface of the base of the cap is further provided with a seal opening member (for example, a perforation member) spaced in alignment with the sealed aperture. Rotation of the cap in threaded engagement with the upper chamber results in an upward movement of the perforation member which perforates the seal of the aperture of the refrigeration chamber, thus venting and dispersing the evaporating refrigerant into the third chamber at atmospheric pressure. The ensuing cooling effect of evaporation and the adiabatic expansion of refrigerant vapor cools the walls of the refrigerant chamber and the base of the upper chamber, cooling the beverage by thermal conduction.

In an alternative embodiment, the upward movement of the seal opening member may be facilitated by a bead-and-groove engagement between the cap and the exterior wall of the upper chamber.

In a further embodiment, the base of the cap may be provided as to be sufficiently flexible to permit upward displacement of the seal opening member by upward manipulation of the cap base as a means of venting the refrigerant.

Further objects and advantages of the invention will become apparent from consideration of the drawings and description thereof.

DESCRIPTION OF THE PREFERRED EMBODIMENTS

Figure 1:
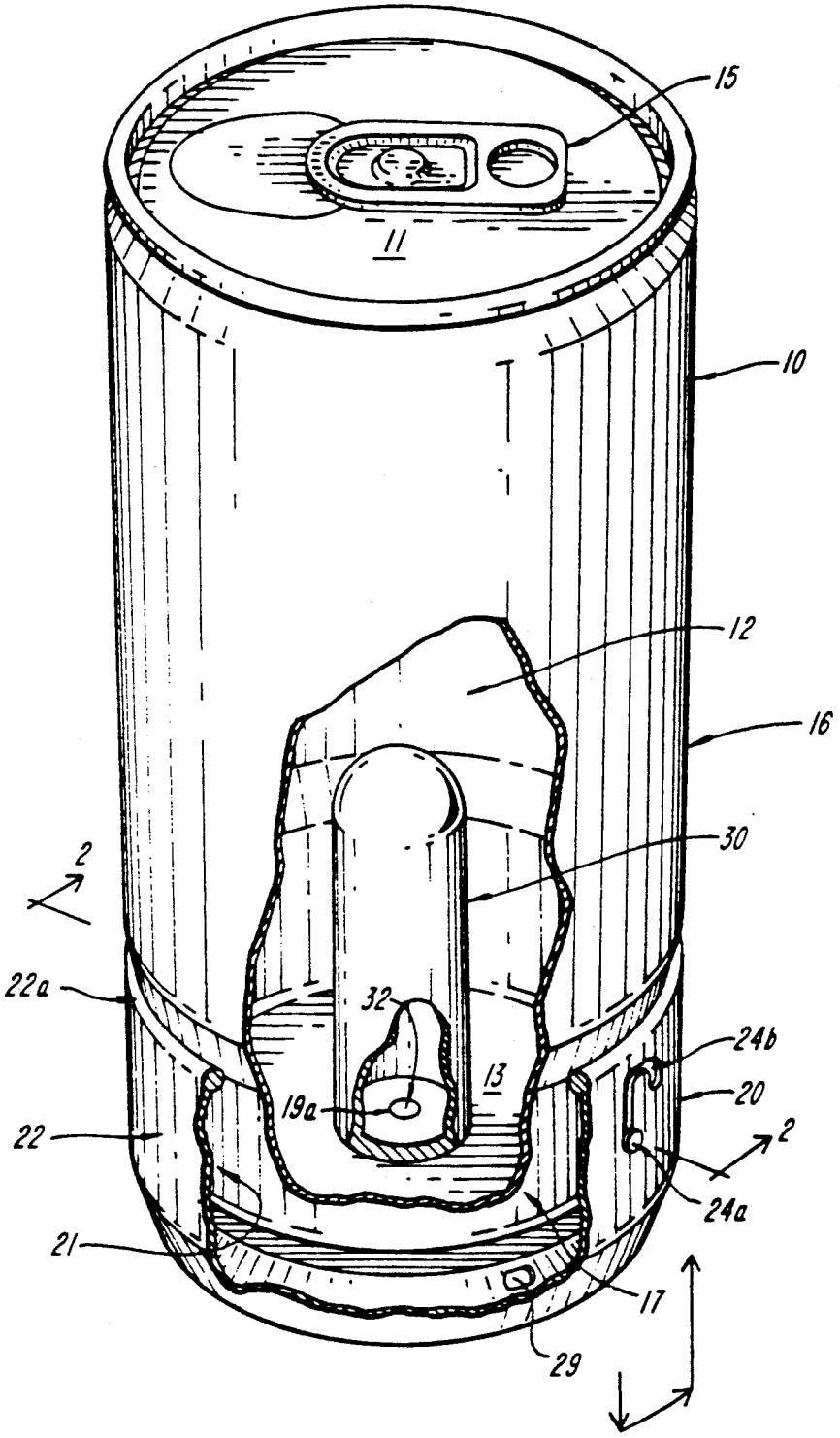
FIG. 1. A perspective view which has been partially cut away of an embodiment of the invention.
Figure 3:
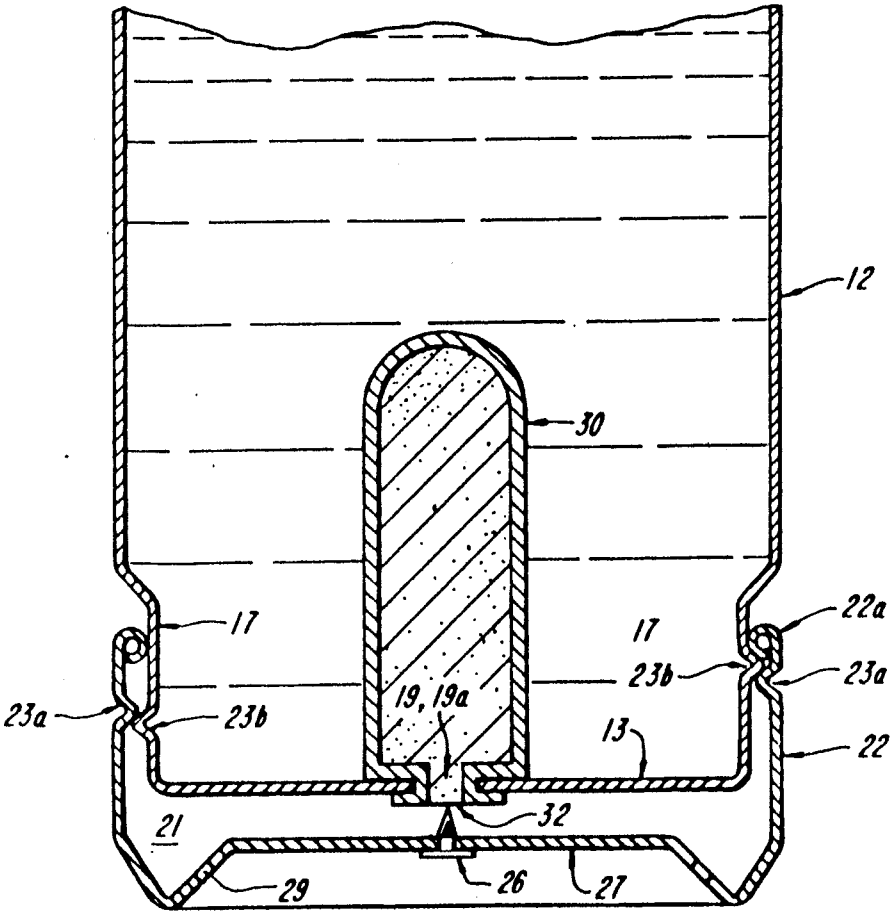
FIG. 3. A sectional view of an alternative embodiment of the present invention prior to refrigerant dispersal.

Referring to the drawings, FIG. 1 shows a self-cooling container for carbonated soft drinks, beer and the like indicated at reference numeral 10. The container is shown having a conventional opening tab 15 on its upper end wall 11 and conforms generally to conventional exterior dimensions and shape of such containers. Each structural component of the invention is of a composition preferably selected from aluminum, steel, aluminum and steel or other metal or metal alloy, plastic or any other material of sufficient strength, heat conductivity and recyclability.

The container 10 is divided into three generally cylindrical chambers: an upper chamber providing a fluid (typically a beverage) vessel 12; a lower chamber providing a refrigerant vapor dispersal vessel 21, and a refrigerant capsule 30 axially disposed within and concentric to the beverage vessel 12.

The beverage vessel 12 of the upper chamber is defined by the walls of cylindrical side wall 16 and generally disc-like top wall 11 and base wall 13. In two of the preferred embodiments, shown in FIGS. 2–5, the cylindrical side wall 16 has a reduced diameter portion 17 at its lowermost end. The base wall 13 of the beverage vessel is axially provided with an aperture 19.

The dispersal vessel 21 of the lower chamber is defined by a separate generally cup-shaped cap 20 having preferably a generally concave base portion 27 and a cylindrical side wall 22. The sidewall 99 of the cap 20 fits radially around the annular reduced portion 17 of the upper chamber. An annular sealing member 99*a* about the upper open edge of the cap 20 is in slidable, rotatable, sealing engagement with the annular reduced portion 17 of the sidewall 16. The sidewall 22 of the cap is in additional engagement with the annular reduced portion 17 of the upper chamber 12 by way of vertical displacement members described in detail below.

The refrigerant capsule 30 is fixed at its lower end by welding or the like, to the base wall 13 of the beverage vessel 12. The capsule includes an interior refrigerant region which contains a predetermined quantity of a refrigerant, under pressure and in liquid form, preferably selected from the group of HFC's developed by DuPont and others. The capsule 30 is axially provided at its lower end with an aperture 19*a* which aligns with the aperture 19 of the beverage vessel base 13.

The apertures are sealed by a sealing element 32—for example, a perforatable foil seal of sufficient strength to maintain the pressurized refrigerant within the closed region interior to the refrigerant capsule 30.

The cavity, or fluid region, defined by the interior walls of the beverage vessel 12 and the exterior walls of the refrigerant capsule contains the beverage to be cooled and is accessible to the consumer via a conventional die-cut pull tab device (openable port) 15.

The cavity, or dispersal region, defined by the interior walls of the cap 20, the exterior of the base wall 13 of the beverage vessel 13, the annular sealing member 22*a* and the perforatable sealing element 32, is exposed to normal atmospheric pressure through venting pores 29 at the base or sides of the cap 20. The sealing element 32 thus forms a common wall (or coupling portion of the walls) between the refrigerant region and the dispersal region. Within the dispersal region, affixed axially to the interior of the cap base portion 27, is a cooling activator which includes a seal opening member. The seal opening member is aligned vertically with the sealing element 32 (i.e., coupling portion) covering aperture 19, 19*a*. FIGS. 2–6 show the seal opening member as a perforation member 26, preferably an acute cone in shape with fluted grooves 26*a* vertically aligned about its circumference. A valve could be substituted for the perforable sealing element 32 and the perforation member 26.

In the operation of cooling the beverage contained in the present invention, the cap 20 is moved upward relative to the beverage vessel 12 guided by the vertical displacement members (discussed below) and slidably sealing the annular sealing member 22*a* about the circumference of the annular portion 17 of the beverage vessel 12. The perforation member 26 is thus vertically displaced within the aligned apertures 19, 19*a*, perforating the sealing element 32, shown in FIG. 6. The refrigerant, upon exposure to normal atmospheric pressure, rapidly evaporates and expands through the apertures 19, 19*a* into the vapor dispersal vessel 21, wherein the volatile vapor is decelerated. The refrigerant capsule 30 and the base wall 13 of the beverage vessel 12 become cooled by conduction as a result of the cooling effect of evaporation and the adiabatic expansion of the refrigerant vapor. This cooling is accordingly conducted to the beverage in vessel 12 which is subsequently cooled.

Figure 2:
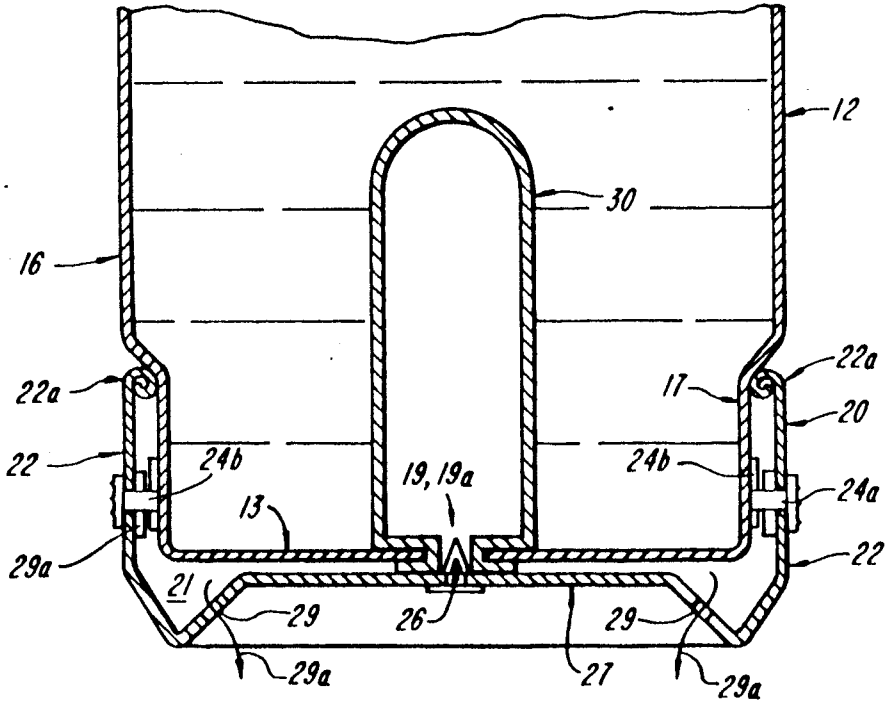
FIG. 2. A sectional view taken along line 2—2 of FIG. 1 illustrating the perforation of the sealing means of the embodiment shown in FIG. 1.
Figure 4:
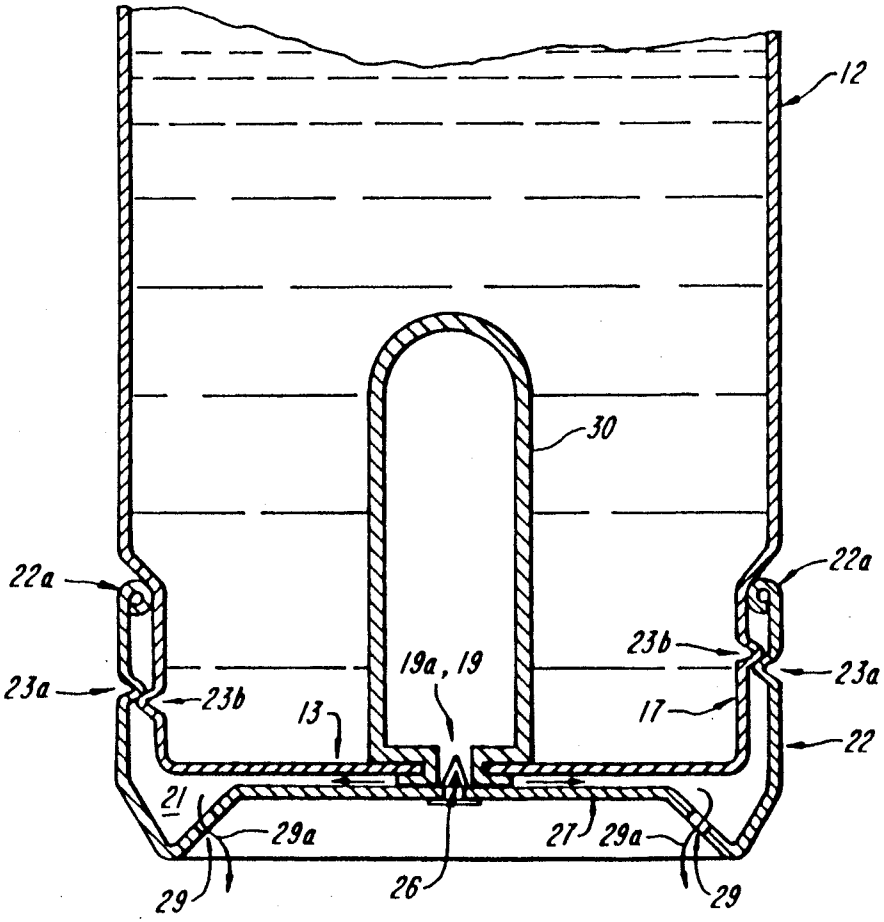
FIG. 4. A sectional view of the embodiment shown in FIG. 3 after refrigerant dispersal.
Figure 6:
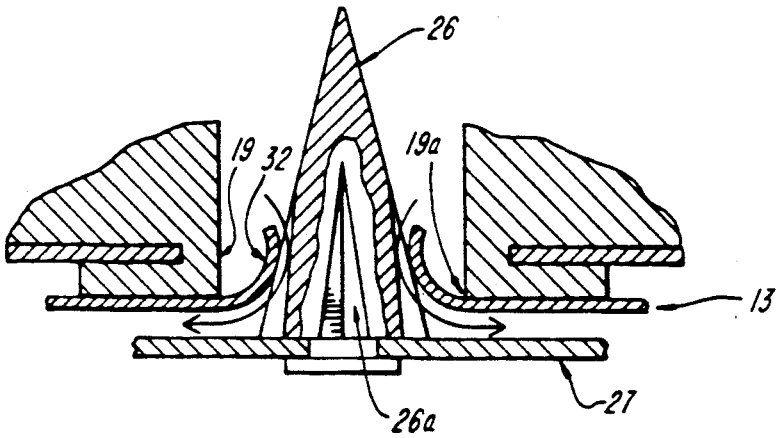
FIG. 6. An enlarged sectional plan view of the perforation member of any of the described embodiments after perforation of the seal of the refrigerant chamber.

The expanding and evaporating refrigerant is vented from the vapor dispersal vessel through the venting pores 29 indicated by the arrows 29*a* in FIGS. 2 and 4. The rate that the refrigerant vapor is vented regulates the efficiency of the cooling effect and is actuated by the size of apertures 19, 19*a*, the size of the vapor dispersal vessel 21 and the size of the venting pores 29. Preferably, an arrangement of vertically aligned baffles (not shown) may be affixed to the cap base 27 within the vapor dispersal cavity to further decelerate the rate of refrigerant vapor dispersal to maximize cooling efficiency.

The aforesaid vertical displacement members guide the sliding vertical displacement of cap 20 about the annular portion 17 of the beverage vessel 12. In a preferred embodiment, thread members 23*a* are provided on the interior side wall 22 in threaded, rotatable engagement with the corresponding thread members 23*b* of the exterior wall of annular portion 17. Thus, vertical displacement of the perforation member 26 is achieved by rotation of the cap 20 about the beverage vessel 12.

In an alternative embodiment, "bayonet"-type sliding engagement between the cap 20 and vessel 12 may be provided whereby a plurality of beads 24*a* fixed to interior side wall 22 are slidable with plurality of corresponding grooves 24*b* located on the exterior wall of annular portion 17. The device is activated by an upward manipulation of the cap 20 with the beads 24*a* guided vertically within grooves 24*b*. Preferably, a horizontal portion of the grooves 24*b* is provided to allow for a rotational locking step to prevent accidental discharge occurring (for example, owing to rough handling).

With regard to both of the above-described embodiments, it is contemplated by the inventor that the cap portion 20 may be a separate unit, with the beverage vessel 12 being vended separately. In such a case, the cap 20 may be integral of the vending machine, for example, and provide a sealed vapor dispersal cavity and perforation member 26 for multiple use in association with each separately vended beverage vessel, in the same manner as described above.

Figure 5:
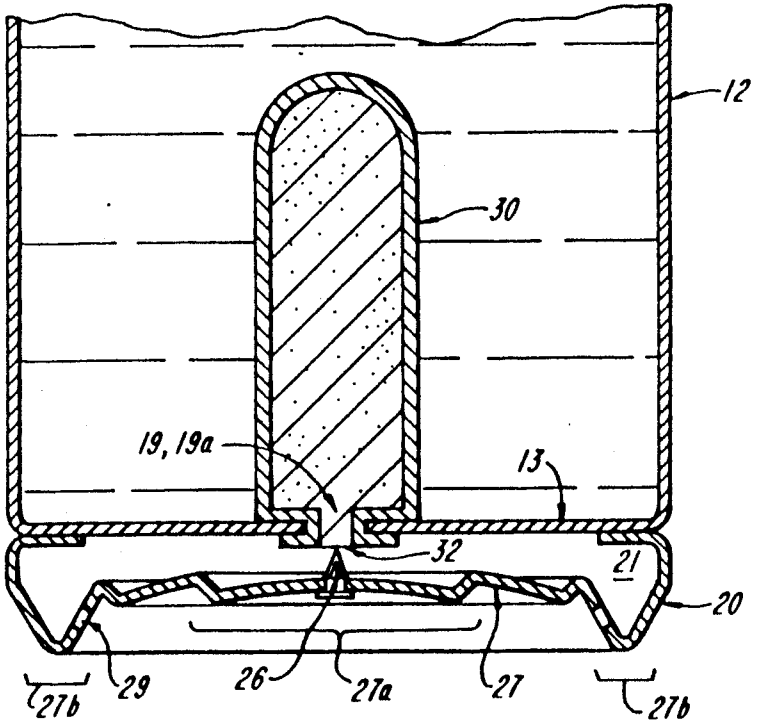
FIG. 5. A sectional view of a third embodiment of the present invention.

In a further embodiment of the invention shown in FIG. 5, the cap 20 is integral of the side walls 16 of beverage vessel 12. Upward displacement of the perforation member 26 as to perforate the refrigerant capsule sealing member 22 is achieved by an upward flexing of the base portion 27 of the vapor dispersal vessel 21. The base portion 27, shown in FIG. 5, is designed to be sufficiently deformable in its centre portion 27*a* to achieve such a displacement, yet sufficiently rigid in its annular outer portion 27*b* to support the weight of the container 10 with minimal deformation.

While the above description contains many specificities, these should not be construed as limitations of the scope of the invention but rather as an exemplification of preferred embodiments thereof. While the described embodiment is for a beverage container, it will be understood that it applies as well to any fluid container. Many variations are possible. Accordingly, the scope of the invention should be determined not by the embodiments illustrated but by the appended claims and their legal equivalent.

What is claimed is:

1. A self-cooling container for fluids, comprising:

A. a first chamber including walls for defining a fluid region interior thereto, B. a second chamber including walls for defining a refrigerant region interior thereto, said refrigerant region extending at least partially into said fluid region and being thermally coupled to said fluid region, and said refrigerant region being fluidicly isolated from said fluid region, C. refrigerant dispersal assembly including:

i. means for forming a third chamber including walls for defining a dispersal region interior thereto, said dispersal region including a first portion adjacent to said refrigerant region and separated therefrom by a coupling portion of said walls of said refrigerant region and including a second portion adjacent to said fluid region and separated therefrom by a coupling portion of said walls of said fluid region, said dispersal region and said fluid region being thermally coupled through said coupling portion of said walls of said fluid region, said third chamber being substantially closed and being vented to regions exterior to said container, ii. cooling activation means for selectively forming a fluidic path from said refrigerant region to said dispersal region through said coupling portion of said walls of said refrigerant region.

2. A self-cooling container in accordance with claim 1 wherein said cooling activation means includes a perforation member supported by one of said walls defining said dispersal region and extending therefrom into said dispersal region toward said coupling portion of said walls, and wherein said wall supporting said perforation member is displaceable in response to an externally, selectively applied force to establish motion of said perforation member, thereby piercing said coupling portion and forming said fluidic path.

3. A self-cooling container in accordance with claim 2 wherein said fluid is a beverage.

4. A self-cooling container in accordance with claim 3 wherein said first chamber is cylindrical having two opposite ends and said second chamber is located axially within said first chamber at one end thereof and wherein said first chamber includes an openable port at the end opposite said one end for dispensing said beverage therefrom.

5. A self-cooling container in accordance with claim 2 wherein said coupling portion is a perforatable seal.

6. A self-cooling container in accordance with claim 2 wherein said first chamber is substantially cylindrical and said second chamber extends from one end of said first chamber.

7. A self-cooling container in accordance with claim 6 wherein said second chamber is substantially cylindrical and is substantially coaxial with said first chamber.

8. A self-cooling container in accordance with claim 2 wherein said displacement of said perforation member is guided by a threaded connection between said first chamber and said third chamber.

9. A self-cooling container in accordance with claim 2 wherein said displacement of said perforation member is guided by a bead-and-groove connection between said first chamber and second chamber.

10. A self-cooling container in accordance with claim 2 wherein said displacement of said perforation member is established by deformation of said wall of said third chamber supporting said perforation member.

11. A self-cooling container in accordance with claim 2 wherein said third chamber forming means includes a cup-shaped member and means for detachably coupling said cup-shaped member to said first chamber, whereby an exterior surface of said walls of said first chamber and an interior surface of said cup-shaped member cooperatively establish said third chamber.

12. A self-cooling container in accordance with claim 1 further comprising a predetermined amount of pressurized refrigerant in said refrigerant region.

13. A self-cooling container in accordance with claim 12 wherein said cooling activation means includes a perforation member supported by one of said walls defining said dispersal region and having a tapered pointed portion extending therefrom into said dispersal region toward said coupling portion of said walls, and wherein said wall supporting said perforation member is displaceable in response to an externally, selectively applied force to establish motion of said tapered, pointed portion through said coupling portion of said walls, thereby piercing said coupling portion and forming said fluidic path.

14. A self-cooling container in accordance with claim 13 wherein said fluid is a beverage.

15. A self-cooling container in accordance with claim 14 wherein said first chamber is cylindrical having two opposite ends and said second chamber is located axially within said first chamber at one end thereof and wherein said first chamber includes an openable port at the end opposite said one end for dispensing said beverage therefrom.

16. A self-cooling container in accordance with claim 13 wherein said coupling portion is a perforatable seal.

17. A self-cooling container in accordance with claim 13 wherein said first chamber is substantially cylindrical and said second chamber extends from one end of said first chamber.

18. A self-cooling container in accordance with claim 17 wherein said second chamber is substantially cylindrical and is substantially coaxial with said first chamber.

19. A self-cooling container in accordance with claim 13 wherein said displacement of said perforation member is guided by a threaded connection between said first chamber and said third chamber.

20. A self-cooling container in accordance with claim 13 wherein said displacement of said perforation member is guided by a bead-and-groove connection between said first chamber and second chamber.

21. A self-cooling container in accordance with claim 13 wherein said displacement of said perforation member is established by deformation of said wall of said third chamber supporting said perforation member.

22. A self-cooling container in accordance with claim 13 wherein said third chamber forming means includes a cup-shaped member and means for detachably coupling said cup-shaped member to said first chamber, whereby an exterior surface of said walls of said first chamber and an interior surface of said cup-shaped member cooperatively establish said third chamber.

23. A self-cooling container in accordance with claim 1 wherein said third chamber forming means includes a cup-shaped member and means for detachably coupling said cup-shaped member to said first chamber, whereby an exterior surface of said walls of said first chamber and an interior surface of said cup-shaped member cooperatively form said third chamber.

24. A refrigerant dispersal assembly for attachment to a container for fluids having a fluid chamber defining an interior fluid region and a closed refrigerant chamber disposed within said fluid chamber and containing a pressurized refrigerant, comprising:

A. a cup-shaped member defining a dispersal region interior thereto, and including means for venting said dispersal region to regions external to said cup-shaped member, B. a perforation member disposed on said cup-shaped member and extending therefrom into said dispersal region, and C. means for coupling said cup-shaped member to said container whereby said perforation member is adjacent said refrigerant chamber and said perforation member is selectively displaceable toward and into said refrigerant chamber, and whereby an exterior wall of said refrigerant chamber and an interior surface of said cup-shaped member substantially enclose said dispersal region, said dispersal region and said fluid region being thermally coupled through said exterior wall.

25. A container for fluids comprising:

A. a first chamber having two opposite ends, and including walls for defining a closed fluid region interior thereto for containing a fluid-to-be-cooled therein, said first chamber being substantially cylindrical, B. a second chamber including walls for defining a closed refrigerant region interior thereto for containing a pressurized refrigerant therein, said refrigerant region extending at least partially into said fluid region and being thermally coupled to said fluid region, said second chamber being substantially cylindrical and extending from one end of said first chamber, said first chamber and said second chamber being coaxial, C. means for receiving a refrigerant dispersal assembly for selectively forming a fluidic path from said refrigerant region to regions exterior to said container, whereby said refrigerant dispersal assembly, together with the walls of said first chamber, define a substantially closed dispersal region thermally coupled through said walls of said first chamber to said fluid region.

26. A container in accordance with claim 25 further comprising said refrigerant dispersal assembly, wherein said refrigerant dispersal assembly includes means for perforating a wall defining said refrigerant region.

27. A self-cooling container in accordance with claim 26 wherein said fluid is a beverage.

28. A container in accordance with claim 27 wherein said first chamber further includes an openable port at the end opposite said one end for dispersing said beverage therefrom.

29. A self-cooling container in accordance with claim 25 wherein said fluid is a beverage.

30. A container in accordance with claim 29 wherein said first chamber further includes a selectively openable port at the end opposite said one end for dispersing said beverage therefrom.

* * * * *